United States Patent [19]

Aschberger et al.

[11] Patent Number: 4,705,193

[45] Date of Patent: Nov. 10, 1987

[54] CIRCULATION PUMP SYSTEM IN A STORAGE VESSEL

[75] Inventors: Matthias Aschberger; Karlheinz Färber, both of Giengen; Anton Deininger, Bachhagel, all of Fed. Rep. of Germany

[73] Assignee: The Coca-Cola Company, Atlanta, Ga.

[21] Appl. No.: 768,367

[22] Filed: Aug. 22, 1985

[30] Foreign Application Priority Data

Aug. 22, 1984 [DE] Fed. Rep. of Germany ..... 3430952

[51] Int. Cl.[4] ..... B67D 5/62

[52] U.S. Cl. ..... 222/146.6; 222/464; 62/392

[58] Field of Search ..... 222/129.1, 146 C, 146.1, 222/464; 62/394, 435, 392; 417/360; 261/D 7

[56] References Cited

U.S. PATENT DOCUMENTS

| | | | |
|---|---|---|---|
| 2,502,610 | 4/1950 | Wegman | 62/435 X |
| 2,559,877 | 7/1951 | Ihle et al. | 222/146.6 X |
| 2,560,526 | 7/1951 | Thompson | 261/D 7 X |
| 2,684,580 | 7/1954 | Sniader et al. | 62/392 X |
| 3,225,965 | 12/1965 | Jacobs et al. | 222/129.1 |
| 4,034,897 | 7/1977 | Brown | 222/146.6 |
| 4,537,332 | 8/1985 | Brown et al. | 62/392 X |

FOREIGN PATENT DOCUMENTS

| | | | |
|---|---|---|---|
| 2749938 | 3/1979 | Fed. Rep. of Germany | 222/146.6 |
| 2024159 | 1/1980 | United Kingdom | 222/146.6 |

*Primary Examiner*—Joseph J. Rolla
*Assistant Examiner*—Nils Pedersen
*Attorney, Agent, or Firm*—Birch, Stewart, Kolasch & Birch

[57] ABSTRACT

A circulation pump system in a storage vessel for liquids, more particularly in a carbonizing tank of a beverage dispenser in which soda water, a mixture of $CO_2$ gas and fresh water, is chilled and stored under pressure for withdrawal via an outlet connection. The circulation pump is mounted directly above the discharge port of the storage vessel so that the small amount of heat released by the circulation pump is utilized to keep the outlet opening free of ice.

3 Claims, 4 Drawing Figures

CIRCULATION PUMP SYSTEM IN A STORAGE VESSEL

The invention relates to a circulation pump system in a storage vessel for liquids, more particularly in a carbonizing tank of a beverage dispenser in which soda water, a mixture of $CO_2$ gas and fresh water, is chilled and stored under pressure for withdrawal via an outlet connection.

These systems are, for example, used for the carbonization of water in beverage dispensers, by means of which carbonized water can be mixed, as required, with beverage concentrates to produce a beverage for consumption. To do this, a storage vessel is employed in which supplied fresh water is chilled and enriched with $CO_2$ gas. To ensure sufficient carbonization of the fresh water, it is necessary, or at least expedient, to carry out the carbonization process in the storage vessel under a high pressure and to assist it by techniques known from the prior art for the enrichment of liquid with gas. This can be realized by means of a circulation pump.

For this purpose, an appropriate unit that brings about the circulation of the liquid must be mounted in the storage vessel and affixed thereto. Therefore, appropriate mounting devices must be provided in this storage vessel.

In the case of liquids that must be cooled down to the freezing point and are particularly subject to pressure and enriched with gas, there is the risk that an ice formation desired in other areas of the storage vessel, especially in the lateral wall areas of the storage vessel, also occurs in the area of the discharge port. But this would definitely disturb the proper operation of the storage vessel, since in this case no more liquid could be withdrawn from the storage vessel.

Based on this knowledge, it is the major object of the invention to provide a system for a carbonizing tank that offers favorable conditions for completely ruling out the disturbances described above.

According to the invention, a system employing a storage vessel provided with a circulation pump is characterized by the fact that the circulation pump is mounted directly above the discharge port of the storage vessel.

A system with this novel design is distinguished by the fact that the discharge port is located in the vicinity of the hottest spot of the storage vessel. By means of the circulation pump and in the area around it, thermal energy is transmitted to the chilled liquid. If water is used, its density converges from the area of the freezing point toward its maximum value, so that the relatively hotter water falls to the area of the discharge port.

According to a preferred embodiment, the novel system is characterized in that the circulation pump is affixed to the wall duct connection of the discharge port of the storage vessel, preferably by means of a bayonet-joint-type connection. The result is a mounting technique for the circulation pump that is most effective from the production engineering and operating viewpoints. The pump can then also be shored with rib-shaped support braces on the bottom of the storage vessel around the fastening point.

A specific embodiment of the invention will now be described with reference to the accompanying drawing, in which.

Figure 1:
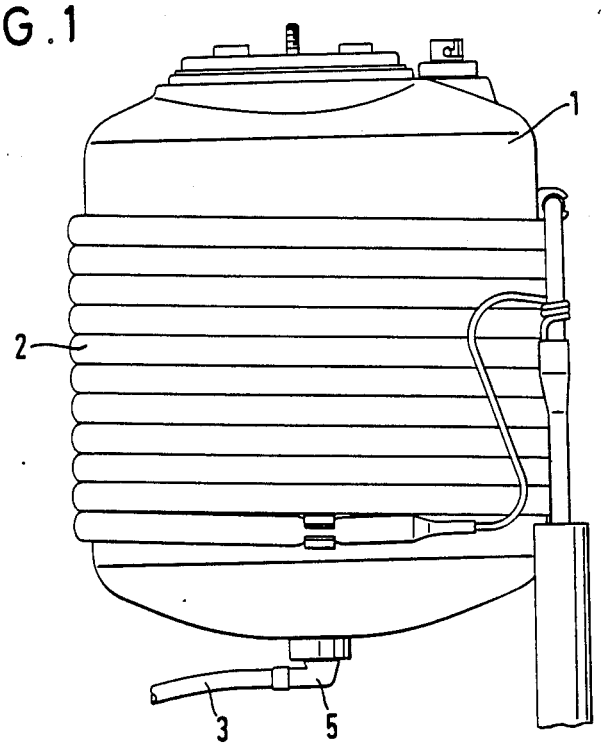
FIG. 1 is a side view of the storage vessel.
Figure 2:
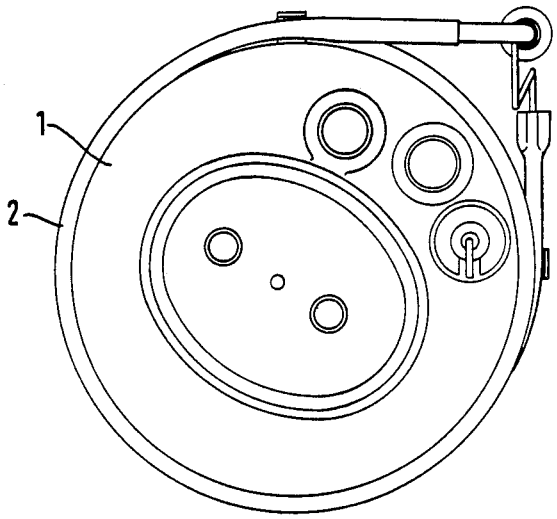
FIG. 2 is a top plan view of this storage vessel.

The storage vessel 1 illustrated in FIGS. 1 and 2 serves as a carbonizing tank for beverage dispensers. Carbonized water is drawn off from this storage vessel 1 by means of cooling coils 2 through a pipe 3. The cooling for this storage vessel 1 is controlled in such a way that in the areas close to the cooling coils 2 and a ring-shaped ice layer is formed in the storage vessel 1. Accordingly, the carbonized water remaining in the center of the storage vessel 1 is cooled down to the freezing point.

Figure 3:
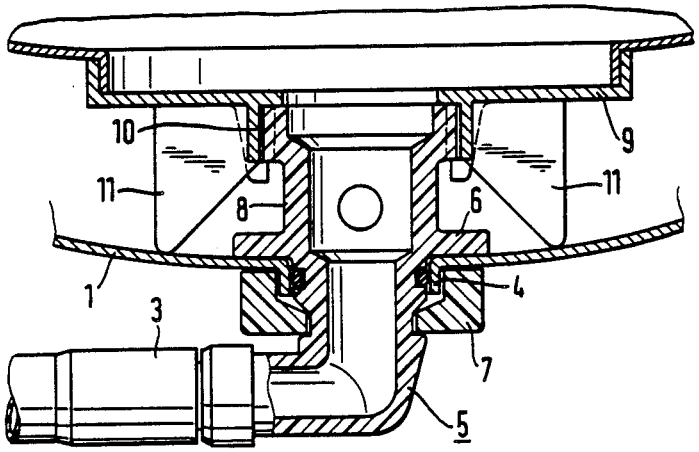
FIG. 3 is a detail view in the fastening area of the circulation pump.

To keep the outlet area of the carbonized water from the storage vessel 1 clear of ice and to provide for an advantageous fastening option for the circulation pump, which assists in the carbonization process in the storage vessel 1, the circulation pump is mounted in the storage vessel 1 and affixed thereto, as shown in FIG. 3. To discharge the carbonized water, a wall duct section or outlet connection 5 is used which is inserted in a discharge port or cylindrical ring section 4 of the storage vessel (1) wall. Inside the storage vessel 1, this wall duct section 5 is supported on the wall by means of a flange 6, while a ring-section plate 7 engaging in an annular groove of this wall duct piece 5 takes care of the outer support.

Figure 4:
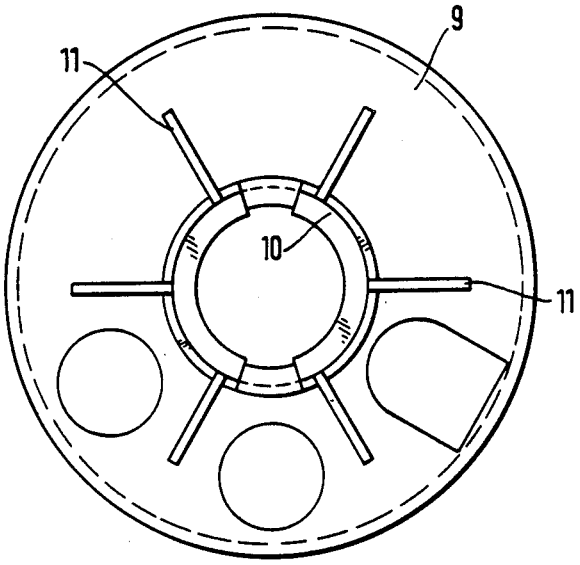
FIG. 4 is a bottom plan view of a portion of FIG. 3.

The circulation pump 9, only the lower bottom section of which is shown, is affixed to a tubular shoulder 8 of the wall duct section 5 by means of a bayonet-joint-type connection 10. The tubular shoulder 8 includes an outlet opening. This circulation pump 9 is supported on the bottom wall of the storage vessel 1 by means of radial support feet 11 mounted on the bottom part of the circulation pump 9. A bottom plan view of pump 9 is shown in FIG. 4.

What is claimed is:

1. A circulation pump system in a storage vessel for a beverage dispenser comprising:

a storage vessel for storing soda water, a mixture of $CO_2$ and fresh water, under pressure;

means for cooling the soda water contained in said storage vessel to the point of frost formation on the walls of the vessel;

said storage vessel having a discharge port;

a wall duct connection secured to said storage vessel for the discharge of the soda water;

said wall duct connection passing through said discharge port and having an outlet opening within said storage vessel;

a circulation pump located completely in said storage vessel and supported by an interior liquid holding portion of said storage vessel directly above said discharge port; and said circulation pump having a bottom area spaced from said storage vessel and overlying said outlet opening.

2. A circulation pump system in a storage vessel for a beverage dispenser comprising;

a storage vessel for storing soda water, a mixture of $CO_2$ and fresh water, under pressure;

means for cooling the soda water contained in said storage vessel to the point of frost formation on the walls of the vessel;

said storage vessel having a discharge port;

a wall duct connection secured to said storage vessel for the discharge of the soda water;

said wall duct connection passing through said discharge port and having an outlet opening within said storage vessel;

a circulation pump mounted in said storage vessel directly above said discharge port;

said circulation pump having a bottom area spaced from said storage vessel and overlying said outlet opening; and said circulation pump is affixed to said wall duct connection for the discharge of the soda water from the storage vessel.

3. A system according to claim 2, characterized in that said circulation pump is affixed by a bayonet joint to said wall duct connection for the discharge of the soda water.

* * * * *